United States Patent [19]

Baldwin et al.

[11] 4,001,057

[45] Jan. 4, 1977

[54] SOLID PROPELLANT WITH $NF_2$ CONTAINING BINDER AND ENERGETIC PLASTICIZER

[75] Inventors: Mart G. Baldwin; Paul H. Gehlhaus, both of Huntsville, Ala.

[73] Assignee: Rohm and Haas Company, Philadelphia, Pa.

[22] Filed: Sept. 24, 1962

[21] Appl. No.: 227,109

[52] U.S. Cl. ..... 149/19.3; 149/19.91; 149/20; 149/22; 149/38; 149/44

[51] Int. Cl.[2] ..... C06B 45/10; C06B 43/00; C06B 33/08

[58] Field of Search ..... 149/19, 38, 22, 44, 149/19.3, 19.91, 20

[56] References Cited

UNITED STATES PATENTS

| | | | |
|---|---|---|---|
| 3,351,505 | 11/1967 | Shapiro et al. | 149/19.3 X |
| 3,439,039 | 4/1969 | Petry et al. | 149/19.3 X |
| 3,535,173 | 10/1970 | Spenadel et al. | 149/19.3 |

*Primary Examiner*—Edward A. Miller

EXEMPLARY CLAIM

1. Compositions suitable for the manufacture of propellants consisting essentially of A. 15 to 40 parts of a monomer selected from the group consisting of compounds of the formula

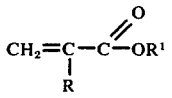

in which R is selected from the group consisting of hydrogen, methyl and ethyl, and $R^1$ is selected from the group consisting of

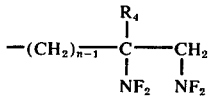

in which $n$ is an integer from 1 to 5, and $R^4$ is selected from the group consisting of H and $CH_3$,

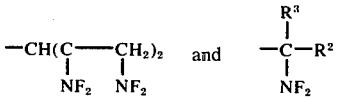

in which $R^2$ is selected from the group consisting of hydrogen and lower alkyl containing 1 to 4 carbon atoms, and $R^3$ is selected from the group consisting of hydrogen and lower alkyl containing 1 to 4 carbon atoms, B. greater than 0 and less than 20 parts of a plasticizer for the polymers prepared by polymerizing the monomers of A), said plasticizers consisting essentially of a major proportion of compounds containing groups selected from the group consisting of $NF_2$ and $ONO_2$, C. 40 to 60 parts of a solid powdered oxidizer, selected from the group consisting of lithium, sodium, potassium and ammonium salts of nitric and perchloric acids and D. 0 to 25 parts of a finely particled readily combustible solid selected from the group consisting of carbon black, aluminum, magnesium, zinc, zirconium, boron, and beryllium.

4 Claims, No Drawings

SOLID PROPELLANT WITH $NF_2$ CONTAINING BINDER AND ENERGETIC PLASTICIZER

This invention concerns propellant compositions which serve as explosives, which compositions can be used as propellant compositions for rocket motors and the like.

More specifically, this invention concerns acrylate and methacrylate esters as binders for propellants in which the alcohol moiety contains $NF_2$ groups. These products, while acting as binders for the propellant compositions, are also high energy compositions and thus do not detract from the specific impulse of the propellant grains. The propellants of the present invention are characterized by high density and good thermal stability and demonstrated specific impulse values as high as 254 seconds in motor firings.

Propellant compositions have been proposed based on gun cotton and nitroglycerin. While these may have rapid burning rates and moderately favorable specific impulses, they must be cartridge-loaded, requiring heavy accessory components which place an unnecessary load upon the rocket motor.

Also several compositions have been developed which comprise a rubbery or resinous binder and an oxidizing agent, which mixtures can be extruded into or packed into a motor casing. While these compositions are quite satisfactory for a variety of applications, such as propellants in shells, artillery rockets, and air-to-air rockets, they are not completely satisfactory for ground-to-air rockets and ballistic missiles which require propellants having maximum specific impulse.

The specific impulse of high performance rockets is of vital importance. For example, an increase of about 10% in specific impulse may well double the range of a ballistic missile.

In addition, the compositions of the art based on resinous binders and an oxidizing agent have been of primary interest in situations in which slow to moderate rates of burning are desirable. The burning rates of these compositions are limited so that they are not adaptable to a great variety of applications.

It is also necessary that a practical propellant meet other criteria, such as thermal stability, storage stability, stability during preparation, insensitiveness to impact, freedom from toxicity to workers preparing the compositions and to those using them, and low pressure and temperature coefficients of burning rates. Also, when the compositions have once been placed within a motor case, they must maintain their given form under wide extremes of temperature and they must be able to withstand the tremendous accelerations to which they will be exposed during firing.

A necessary requirement is that a propellant be formed without voids, cracks or fissures. One consequence of such defects is that the propellant charge may detonate upon firing. Again, if a propellant possesses such faults and should be fired apparently successfully, the charge tends to break up with ejection of unburned portions and the full energy of the propellant cannot be utilized.

To meet the above and other requirements there is first formulated a primary composition which can be stored, transported and finally placed and cured in a motor when and where desired. The primary composition is converted into a fixed composition in the form of grains or of a grain when it is cured. This fixed composition is used as a propellant.

The primary composition is fluid as first prepared or when it is heated. In a fluid state, it may be mixed with a free radical polymerization initiator, cast into a mold or a casing which serves as both mold and container, and cured by heating. If desired, the primary composition, when cast in a motor casing, is case-bonded thereto and this is one of the important advantages of the compositions of this invention. During the curing step, unsaturated components of the primary mixture are polymerized together. The fixed composition is stable, useful and effective over a wide range of temperatures, such as −30° to 60° C.

The binder, which is used in the proportion of 15 to 40% of the mix, is a monomer selected from the group consisting of compounds of the formula

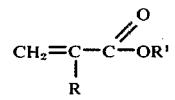

in which R is selected from the group consisting of hydrogen, methyl and ethyl, and $R^1$ is selected from the group consisting of

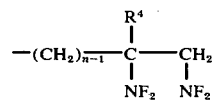

in which $n$ is an integer from 1 to 5, and $R^4$ is selected from the group consisting of H and $CH_3$,

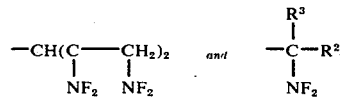

in which $R^2$ is selected from the group consisting of hydrogen and lower alkyl containing 1 to 4 carbon atoms, and $R^3$ is selected from the group consisting of hydrogen and lower alkyl containing 1 to 4 carbon atoms.

Monomers used as binders in the propellants of the present invention are prepared by reacting acrylic and alkacrylic acid chlorides or anhydrides with $NF_2$-containing carbinols. These reactions are well-known with the acid chlorides and anhydrides and other alcohols and, when using the acid chloride, it is common practice to employ a tertiary amine as HCl acceptor.

The alcohols of the formula

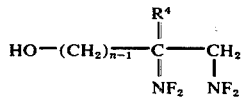

in which $n$ is an integer from 1 to 5, are prepared by reacting esters with $N_2F_4$. Thus, allyl trifluoroacetate is reacted with tetrafluorohydrazine, $N_2F_4$, to give the adduct which is then transesterified with methanol to give 2,3-bis(difluoramino)-propanol-1. In a similar manner, vinyl trifluoroacetate by the same series of reactions, gives 1,2-bis(difluoramino)ethanol.

Typical of the carbinols of this type are:
1,2-bis(difluoramino)ethanol,
2,3-bis(difluoramino)-2-methyl-propanol-1,
2,3-bis(difluoramino)butanol-1,
1,2-bis(difluoramino)pentanol-3, and
5,6-bis(difluoramino)hexanol-3.
The alcohols of the formula

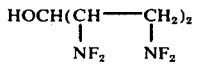

are prepared by the addition of $N_2F_4$ to double bonds followed by further reaction. Thus, divinyl alcohol is esterified by reacting with trifluoroacetic anhydride, the resulting ester is reacted with two moles $N_2F_4$ and the adduct is transesterified with methanol to produce bis(1,2-difluoraminoethyl)carbinol, which can also be named 1,2,4,5-tetrakis(difluoramino)pentanol-3.

The alcohols of the formula

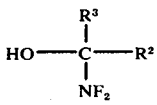

are prepared by reacting compounds of the formula

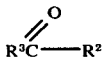

with difluoramine, $HNF_2$, $R^2$ and $R^3$ are as hereinbefore described. Typical of these alcohols are: α-difluoraminomethanol, α-difluoraminoethanol, and α-difluoraminobutanol.

The ratios of anhydride to alcohol can be varied widely and still be within the scope of the present invention. However, in the preferred embodiment, a slight excess over the theoretical amount of anhydride is used to insure as complete utilization of the alcohol as possible. Thus, 1.1 to 1.2 moles of anhydride are used for 1 mole of alcohol.

The order of addition is not important and the alcohol may be added to the anhydride or vice versa. Since the reaction is exothermic and since it is desired to maintain the reaction mixture at a relatively low temperature to prevent polymerization of the product, it is preferred to employ stepwise addition of the one reactant to the other. External cooling may also be employed during addition to control the temperature of the reaction mixture. The reaction temperature employed will depend on the particular reactants, but will be in the range of 10° C. to 50° C., 10° to 30° C. being preferred.

Solvents may also be used to control the exotherm, although in the preferred embodiment they are not. Any solvent which is inert, i.e. does no react with the reactant or the product under the reaction conditions can be used and suitable solvents include diethyl ether, methylene chloride, benzene, toluene, etc.

It is preferred that the reaction be conducted under anhydrous conditions, preferably in an inert atmosphere, such as nitrogen, argon or helium.

A particularly preferred binder is 2,3-bis(difluoramino)propyl acrylate, referred to hereinafter as "NFPA."

The monomers are mixed with a solid powdered oxidizer typical of which are the lithium, sodium, potassium and ammonium salts of nitric and perchloric acids.

Solid combustible particles can be added to the mix, typical of which are carbon black, aluminum, magnesium, zinc, zirconium, boron and beryllium. These solid particles, particulaly when in leaf form, may assist in suspending coarse pieces of oxidizer, as when it is desired to use an oxidizer in relatively coarse form, to provide a relatively slower rate of burning. These solid particles can also influence the physical nature of the compositions, acting as strengthening and reinforcing solids. The amount of solid combustible particles will not exceed 25% of the total weight of the propellant.

These solid particles may be in the form of amorphous or crystalline powders or in leaf form, such as is used for preparing leaf pigments or powders for paints.

On the other hand, when it is desirable to increase the viscosity of the primary composition, as, for example, when it is sought to prevent settling of other solid particles, such as particles of oxidizer, then the use of flakes or leafing powders is indicated, at least to the extent still permitting the flow of the heated primary composition. In many cases, a mixture of a leafing powder and an atomized powder is called for because this permits use of a relatively high portion of combustible solid particles with attendant advantages in high energy relationships.

The propellant is prepared by charging the polymerizable monomer to a jacketed mixer; the plasticizer, if one is used, is then added. The solid powdered oxidizer is then mixed in, followed by the solid combustible compound, if one is used. Particularly if the composition is to be transported or stored for any protracted periods, it is advisable that a polymerization inhibitor be used. Thus, if it is desired to store the monomer for a protracted period of time prior to compounding the propellant, the inhibitor will invariably be added to the monomer. If not, it may be added directly to the propellant mixture.

When it is desired to cast the propellant into a motor or casing, the propellant can be warmed, if necessary, to liquefy it and a polymerization initiator is then added. As soon as the polymerization initiator has been intimately admixed, the composition is poured into the casing, which has previously been cleaned and degreased. The entire assembly containing the propellant is then subjected to temperatures in the range of 40° to 60° C. until the monomer has polymerized.

It is very desirable to subject the fluid propellant mixture to reduced pressure and this can be done before loading it into the casing or after loading it into the casing. This vacuum treatment removes gases absorbed or trapped in th fluid mixture, thereby preventing voids in the final casting. Pressures below 100 mm. are preferred.

Typical polymerization initiators are well-known, hydroquinone, the methyl ether of hydroquinone, tert-butyl catechol, and diphenyl picrylhydrazyl being among the more common.

Curing or polymerization initiators of both the azo and peroxide type have been used and a very wide range of curing rates can be obtained at moderate temperatures.

Suitable catalysts which provide free radicals which function as reaction inhibitors include benzoyl peroxide, tert-butyl hydroperoxide, cumene peroxide, tetralin peroxide, acetyl peroxide, caproyl peroxide, tert-butyl perbenzoate, tert-butyl diperphthalate, methyl ethyl ketone peroxide, etc.

The amount of peroxidic catalyst required is roughly proportional to the concentration of the mixture of monomers. The usual range is 0.01% to 3% of catalyst with reference to the weight of the monomer mixture. The preferred range is from 0.2% to 1.5%. The optimum amount of catalyst is determined in large part by the nature of the particular monomers selected, including the nature of the impurities which may accompany said monomers.

Another suitable class of free radical generating compounds are the azo catalysts. There may be used, for example, azodiisobutyronitrile, azodiisobutyramide, azobis($\alpha$,$\alpha$-dimethylvaleronitrile), azobis($\alpha$-methylbutyronitrile), dimethyl, diethyl, or dibutyl azobis(-methylvalerate). These and other similar azo compounds serve as free radical initiators. They contain an -N-N-group attached to aliphatic carbon atoms, at least one of which is tertiary. An amount of 0.01% to 2% on the weight of monomer or monomers is usually sufficient.

The liquid plasticizer is preferably of the type which will help support combustion by virtue of the presence of the nitro or nitrato or $NF_2$ groups. If a lower specific impulse can be tolerated, then other plasticizers, not containing the high energy groups, can be used. Typical of the plasticizers which help support combustion are butanetriol trinitrate, diethylene glycol dinitrate, triethylene glycol dinitrate, and tetraethylene glycol dinitrate. Particularly advantageous is 2,3-bis(difluoramino)propyl-2,3-bis(difluoramino)isobutyrate, this being prepared by the reaction of allyl methacrylate with two moles of tetrafluorohydrazine, $N_2F_4$. There is addition to both the double bonds to give a tetrakis(difluoramino) compound, which is hereinafter referred to as "NFPMAA."

Typical of the compositions of the present invention are the following:

| | (NF-5) (wt.%) | NF-69 (wt.%) |
|---|---|---|
| Ammonium perchlorate | 54 | 55 |
| Aluminum | 11 | 15 |
| NFPA | 35 | 20 |
| NFPMAA | — | 10 |

NF-5 is typical of the non-plasticized composition, whereas NF-69 is typical of a plasticized composition in which the plasticizer is a high energy composition, NFPMAA, as previously described.

These propellants are prepared as described in the following examples:

EXAMPLE I

Propellant NF-5

These are charged to a jacketed kettle 35 parts of 2,3-bis(difluoramino)propyl acrylate. The kettle is maintained at 70° to 75° F. with water in the jacket. The charge is stirred and thereto is added 0.1 – 0.2 part of 2,4-dichlorobenzoyl peroxide. Stirring is continued until all the peroxide is dissolved. Thereupon, there is stirred into this solution 53 parts of ammonium perchlorate of an average particle size of 65$\mu$ and 12 parts of atomized aluminum powder, 100% of which passes a 100 mesh screen and 90% of which passes a 325 mesh screen. The mixture is now subjected to reduced pressure (20 mm.) while stirring is continued. The resulting mixture is cast into a motor casing which has been suitably cleaned and dried. The motor casing contains a mandrel placed to impart a desired shape at the center of the final solid propellant casting. After casting, the filled motor is placed in an oven at 40°–50° C. for 8 to 24 hours depending upon the size of motor and amount of peroxide polymerization initiator added. After curing, the mandrel is withdrawn, the top of the casting trimmed if necessary and a nozzle is attached to the motor with other acccessories needed for ballistic evaluation.

EXAMPLE II

Propellant NF-69

The above procedure set forth in Example I is followed for plasticized systems such as NF-69. The liquid plasticizer is charged to the mixer separately or with the 2,3-bis(difluoramino)propyl acrylate. All other procedures are the same.

Propellant Physical Properties:

Data obtained from a number of representative NF-5 propellant batches are listed in the following table. In addition to ambient temperature mechanical properties of the cured propellant, there are given data on the mix viscosity, curing rate and residual monomer contents of the batches. These refer to batches ranging in size from 1–2 lbs.

TABLE I

| Batch No. | Initial Viscosity | Properties of NF-5 Batches: Curing Rate at 50° C. | Tensile Strength at 75° F. | Elongation at 75° F. | Sp.G. | Residual Monomer |
|---|---|---|---|---|---|---|
| 1001 | 8,000 cp. (est.) | 0.5%/min. | 107 psi | 35% | 1.815 | |
| 1002 | 2,400 cp. at 70° F. | | 131 | 15 | 1.81 | |
| 1003 | 10,800 cp. at 57 | | 102 | 60 | 1.81 | 0.5% |
| 1004 | 7,200 cp. at 66 | | 96 | 70 | 1.81 | 0.3 |
| 1005 | 9,200 cp. at 64 | 0.7%/min. | 108 | 70 | 1.81 | 1.1 |
| 1006 | 6,400 cp. at 60 | 0.4%/min. | 123 | 40 | 1.81 | 1.9 |
| 1008 | 10,400 cp. at 67 | 0.7%/min. | 131 | 40 | 1.81 | 0.3 |
| 1009 | 10,800 cp. | 0.8%/min. | 140 | 50 | 1.82 | 0.25 |
| 1010 | 9,000 cp. at 69 | 1.7%/min. | 125 | 50 | 1.81 | 0.25 |
| 1011 | 12,000 cp. at 72 | 2.8%/min. | 123 | 35 | 1.81 | 0.2 |

In addition to the 75° F. mechanical properties shown in TABLE I values were obtained at −40° F. on a single batch, 1002. Unfortunately, this batch was atypical as judged by the initial viscosity and 75° F. elongation. Even allowing for this anomalous behavior, the low temperature properties included in TABLE II indicate a probable limitation of this composition.

TABLE II

Mechanical Properties of NF-5 at Three Temperatures

| Temperature - ° F. | Tensile Strength-psi | Elongation-% |
|---|---|---|
| −40 | 1400 | <5 |
| +77 | 131 | 15 |
| +142 | 81 | 35 |

*Density - 1.82 g./cc.

Mechanical Properties of NF-69

| Temperature - ° F. | Tensile Strength-psi | Elongation-% (at break) |
|---|---|---|
| −40 | 400 | 25 |
| 75 | 80 | 140 |
| 135 | 50 | 180 |

Density - 1.85 g./cc.

Ballistic Properties:

A number of motors, ranging in size from 10 grams to 1 lb. have been successfully fired. Representative values of NF-5 ballistic parameters are given in the following table:

TABLE III

| Ballistic Properties of NF-5 | |
|---|---|
| Burning Rate, $r_{1000}$ (in./sec.) | 0.80 |
| Pressure Exponent, n | 0.50 |
| Theoretical $I_{sp}$ (sec.) | 266.1 |
| Delivered $I_{sp}$ (sec.) | 242.0* |
| Corrected $I_{sp}$, $F°_{1000}$ (sec.) | 254.4* |
| Characteristic Velocity, C* (ft./sec.) | 5257.0* |

*The average of ten firings in 10-gram 0.75 (C 0.5) 1.5 micromotors.

Measured specific impulse values of about 245 sec. were obtained with NF-69 from a limited number of 10 gram motor firings.

Thermal Stability and Sensitivity:

Sensitivity

Card gap tests of some NF-5 charges gave an approximate value in 1-inch water pipe of 22 cards (0.17 to 0.21 inches). The minimum diameter of cured NF-5 was between 0.62 and 0.82 inches in steel confinement. The impact sensitivity of NF-5 is about 11 kg. - in. (RDX 9–10 kg. - in.).

Thermal Stability

Some values of time to explosion as a function of temperature for NF-5 are shown in Table IV for tests in 22 cartridges. The superior stability exhibited by the NFPA propellant is one of the most attractive features of this composition. Even allowing for the detrimental effect of possible impurities in the propellant, NF-5 is significantly more thermally stable than nitrocellulose plastisol propellants. The polymer decomposition reaction appears to be autocatalytic; however, aluminum in the propellant composition has an inhibiting effect on the autocatalysis.

TABLE IV

Thermal Stability of Compositions 112 and NF-5

| Temperature -° C. | Time to Explosion - seconds NF-5 |
|---|---|
| 180 | >1000 |
| 190 | 110 |
| 200 | 80 |
| 220 | 35 |
| 250 | 25 |

Preliminary data for NF-69 indicate that its sensitivity and thermal characteristics are not markedly different from those of NF-5.

EXAMPLE III

An equivalent weight of 5,6-bis(difluoramino)hexyl methacrylate was substituted for the 2,3-bis(difluoramino)propyl acrylate in Example I. The procedure of Example I was followed and a high density void-free propellant grain was obtained.

EXAMPLE IV

An equivalent weight of α-difluoraminoethyl acrylate was substituted for the NFPA used in Example II. The procedure as set forth hereinbefore was followed, and a propellant grain with comparable properties with that of NF-69 was obtained.

We claim:

1. Compositions suitable for the manufacture of propellants consisting essentially of A. 15 to 40 parts of a monomer selected from the group consisting of compounds of the formula

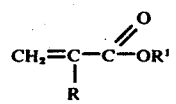

in which R is selected from the group consisting of hydrogen, methyl and ethyl, and $R^1$ is selected from the group consisting of

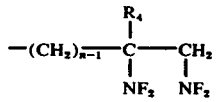

in which n is an integer from 1 to 5, and $R^4$ is selected from the group consisting of H and $CH_3$,

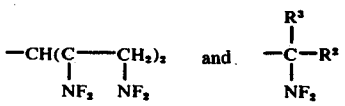

in which $R^2$ is selected from the group consisting of hydrogen and lower alkyl containing 1 to 4 carbon atoms, and $R^3$ is selected from the group consisting of hydrogen and lower alkyl containing 1 to 4 carbon atoms, B. greater than 0 and less than 20 parts of a plasticizer for the polymers prepared by polymerizing the monomers of A), said plasticizers consisting essentially of a major proportion of compounds containing groups selected from the group consisting of $NF_2$ and $ONO_2$, C. 40 to 60 parts of a solid powdered oxidizer, selected from the group consisting of lithium, sodium, potassium and ammonium salts of nitric and perchloric acids and D. 0 to 25 parts of a finely particled readily combustible solid selected from the group consisting of carbon black, aluminum, magnesium, zinc, zirconium, boron, and beryllium.

2. Compositions as set forth in claim 1 in which the monomer is 2,3-bis(difluoramino)-propyl acrylate.

3. A composition as set forth in claim 1 in which the plasticizer is 2,3-bis(difluoramino)propyl-2,3-bis(difluoramino)isobutyrate.

4. Compositions as set forth in claim 1 in which the finely particled readily combustible solid is aluminum.

* * * * *